US010975520B2

(12) United States Patent
Hart et al.

(10) Patent No.: US 10,975,520 B2
(45) **Date of Patent: *Apr. 13, 2021**

(54) FIBER BLEND HAVING HIGH YIELD AND ENHANCED PULP PERFORMANCE AND METHOD FOR MAKING SAME

(71) Applicant: WestRock MWV, LLC, Atlanta, GA (US)

(72) Inventors: Peter W. Hart, Atlanta, GA (US); Darrell M. Waite, Bangor, ME (US); Dale E. Nutter, Jr., Pace, FL (US); Jared Bradberry, Hampden, ME (US)

(73) Assignee: WestRock MWV, LLC, Atlanta, GA (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/043,472

(22) Filed: Jul. 24, 2018

(65) Prior Publication Data

US 2018/0347110 A1 Dec. 6, 2018

Related U.S. Application Data

(63) Continuation of application No. 14/679,556, filed on Apr. 6, 2015, now Pat. No. 10,060,075, which is a (Continued)

(51) Int. Cl.
*D21C 3/02* (2006.01)
*D21B 1/16* (2006.01)
(Continued)

(52) U.S. Cl.
CPC ..... *D21C 3/02* (2013.01); *D21B 1/16* (2013.01); *D21C 9/007* (2013.01); *D21H 11/04* (2013.01);
(Continued)

(58) Field of Classification Search
CPC ..... D21C 3/02; D21C 11/08
(Continued)

(56) References Cited

U.S. PATENT DOCUMENTS 4,220,498 A * 9/1980 Prough ..... D21C 9/1068 162/236
6,576,049 B1 * 6/2003 Dilts ..... D21H 21/16 106/219
2009/0032207 A1 * 2/2009 Laurila-Lumme ..... D21B 1/12 162/55

OTHER PUBLICATIONS

Rydholm, Pulping Processes, 1965, Interscience Publishers, p. 420-422. (Year: 1965).*

(Continued)

*Primary Examiner* — Anthony Calandra
(74) *Attorney, Agent, or Firm* — Walters & Wasylyna LLC

(57) ABSTRACT

The present disclosure relates to producing paper or paperboard having improved stiffness and strength, compared to the conventional paperboard at the same basis weight. It also discloses a method of wood pulping having a significantly increased yield and providing fiber pulps with enhanced properties such as strength and stiffness. Wood chips are chemically pulped to a high kappa number, providing a rejects component and an accepts component. The rejects component is subjected to a substantially mechanical pulping process, optionally in a presence of bleaching agent, prior to blending back into the accepts component. The resulting fiber blend is washed, optionally bleached, and subjected to a papermaking process to provide paper or paperboard with enhanced strength and stiffness at low basis weight.

25 Claims, 3 Drawing Sheets

Related U.S. Application Data continuation of application No. 11/761,535, filed on Jun. 12, 2007, now abandoned.

(51) Int. Cl.

| | |
|---|---|
| ***D21C 9/00*** | (2006.01) |
| ***D21H 11/20*** | (2006.01) |
| ***D21H 21/18*** | (2006.01) |
| ***D21H 27/30*** | (2006.01) |
| ***D21H 27/38*** | (2006.01) |
| ***D21H 11/04*** | (2006.01) |
| ***D21H 11/08*** | (2006.01) |
| ***D21H 17/67*** | (2006.01) |
| ***D21H 21/32*** | (2006.01) |

(52) U.S. Cl.

CPC ..... *D21H 11/08* (2013.01); *D21H 11/20* (2013.01); *D21H 17/675* (2013.01); *D21H 21/18* (2013.01); *D21H 21/32* (2013.01); *D21H 27/30* (2013.01); *D21H 27/38* (2013.01)

(58) Field of Classification Search

USPC ..... 162/17

See application file for complete search history.

(56) References Cited

OTHER PUBLICATIONS

Smook, Handbook for Pulp and Paper Technologists, 1992, Angus Wilde Publications, 2nd edition, chapters 4, 9 and 11. (Year: 1992).*

Leask, Mechanical Pulping: Chapter XVII Reject Refining, 1987,The Joint Textbook Committee of the Paper Industry, vol. 2, p. 210-216. (Year: 1987).*

Nanko et al., Effect of Refining on Vessel Picking, 1988, Japanese Pulp and Paper rearch Insititute, 63 (3), abstract. (Year: 1988).*

Grace, ed., Alkaline Pulping, Joint Textbook Committee of the Paper Industry, 1989, vol. 5, p. 117, 118, 254, 255, 318-365. (Year: 1989).*

Metso, Hi-Consistency Refining Systems for Modern Sack Kraft Paper Production, Jun. 17, 2004, Metso Corporation. (Year: 2004).*

* cited by examiner

FIBER BLEND HAVING HIGH YIELD AND ENHANCED PULP PERFORMANCE AND METHOD FOR MAKING SAME

REFERENCE TO RELATED APPLICATIONS

This application is a continuation of U.S. application Ser. No. 14/679,556 filed on Apr. 6, 2015 (pending) which is a continuation of U.S. application Ser. No. 11/761,535 filed on Jun. 12, 2007 (abandoned), which are hereby incorporated by reference in their entirety.

BACKGROUND OF THE INVENTION

Two main processes have been used for wood pulping: mechanical pulping and chemical pulping. Mechanical pulping primarily uses mechanical energy to separate pulp fibers from wood without a substantial removal of lignin. As a result, the yield of mechanical pulping is high, typically in the range of 85-98%. The produced fiber pulps generally have high bulk and stiffness properties. However, mechanical pulping consumes a high level of operational energy, and the mechanical pulps often have poor strength.

In order to reduce the required energy level and improve fiber strength, other process options have been used in a combination with mechanical energy. Thermomechanical pulping (TMP) grinds wood pulps under steam at high pressures and temperatures. Chemi-thermomechanical pulping (CTMP) uses chemicals to break up wood pulps prior to a mechanical pulping. The CTMP pulping has somewhat lower yield than mechanical pulping, but it provides pulp fibers with a slightly improved strength. Sodium sulfide has been the main chemical used for CTMP pulping. Within the past 10 years, the industry has begun to use hydrogen peroxide as an impregnation chemical and as a chemical directly applied to a high consistency refiner treatment for CTMP pulping. This pulping process, known as alkaline peroxide mechanical pulping (APMP), provides fiber pulps with enhanced brightness and improved strength compared to the traditional CTMP pulping. Additionally, recent breakthroughs in the APMP pulping have been associated with a reduction of the required refining energy through an application of a secondary, low consistency refining system and an enhancement of barrier screening technology to selectively retain rejects while allowing the desirable fibers to pass through to a paper machine.

Chemical wood pulping is a process to separate pulp fibers from lignin by employing mainly chemical and thermal energy. Normally, lignin represents about 20-35% of the dry wood mass. When the majority of the lignin is substantially removed, the pulping provides approximately a 45-53% pulp yield.

Chemical pulping reacts wood chips with chemicals under pressure and temperature to remove lignin that binds pulp fibers together. Chemical pulping is categorized based on the chemicals used into kraft, soda, and sulfite. Alkaline pulping (AP) uses an alkaline solution of sodium hydroxide with sodium sulfide (kraft process) or without sodium sulfide (soda process). Acid pulping uses an acidic solution of sodium sulfite (sulfite process). Chemical pulping provides pulp fibers with, compared to mechanical pulping, improved strength due to a lesser degree of fiber degradation and enhanced bleachability due to a lignin removal.

In the chemical process, wood is "cooked" with chemicals in a digester so that a certain degree of lignin is removed. A kappa number is used to indicate the level of the remaining lignin. The pulping parameters are, to a large degree, able to be modified to achieve the same kappa number. For example, a shorter pulping time may be compensated for by a higher temperature and/or a higher alkali charge in order to produce pulps with the same kappa number.

Kraft pulping has typically been divided into two major end uses: unbleached pulps and bleachable grade pulps. For unbleached softwood pulps, pulping is typically carried out to a kappa number range of about 65-105. For bleachable grade softwood kraft pulps, pulping is typically carried out to a kappa number of less than 30. For bleachable grade hardwood kraft pulps, pulping is typically carried out to a kappa number of less than 20.

For bleachable grade pulps, kraft pulping usually generates about 1-3 weight % of undercooked fiber bundles and about 97-99 weight % of liberated pulp fibers. The undercooked, non-fiberized materials are commonly known as rejects, and the fiberized materials are known as accepts pulp. Rejects are separated from accepts pulp by a multiple stage screening process. Rejects are usually disposed of in a sewer, recycled back to the digester, or thickened and burned. In a few circumstances, rejects are collected and recooked in the digester. However, using this prior technology, drawbacks exist from recooking the rejects which include an extremely low fiber yield, a potential increase in the level of pulp dirt, and a decrease in pulp brightness (poorer bleachability).

Modern screen rooms are typically designed to remove about 1-2 weight % of rejects from a chemical pulping process. If a mill experiences cooking difficulties and accidentally undercooks the pulp, the amount of rejects increases exponentially. Modern bleachable grade kraft pulp screen rooms are not physically designed to process pulps with greater than about 5% by weight of rejects. When the level of rejects increases to slightly above 4-5% by weight, either the screen room plugs up and shuts down the pulp mill, or the screen room is bypassed and the pulp is dumped onto the ground or into an off quality tank and disposed of or gradually blended back into the process. Therefore, bleachable grade kraft pulps are conventionally cooked to relatively low kappa numbers (20-30 for softwoods and 12-20 for hardwoods) to maintain a low level of rejects and good bleachability.

There has been a continuing effort to increase the yield of a chemical pulping process, while maintaining the chemical pulp performance such as high strength. In 2004-2007, the U.S. Department of Energy's Agenda 20/20 program sponsored several research projects to achieve this manufacturing breakthrough endeavor. The Agenda 20/20 program, American Forest and Products Association (AF&PA), and the U. S. Department of Energy jointly published a book in 2006 that define one of the performance goals for breakthrough manufacturing technologies would be "Produce equivalent/better fiber at 5% to 10% higher yield". Target pulp yield increases of 5-10% are considered to be revolutionary to the pulp producing industry. To date, the Agenda 20/20 funded projects have achieved, at best, a 2-5% pulp yield increase. These developed technologies include a double oxygen treatment of high kappa pulps, a use of green liquor pretreatment prior to pulping, and a modification of pulping chemicals and additives used for pulping. However, all other known attempts to achieve a breakthrough of 5-10% yield increase have failed. Other known chemical pulping modifications to increase pulp yield include a use of digester additives such as anthraquinone, polysulfide, penetrant or various combinations of these materials. Again in all instances, only 1-5% yield increase over a traditional kraft pulping process has been realized. Additionally, the modified chemical pulping process often provides fiber pulps with lower tear strength.

Accordingly, there is a need for a novel pulping process with a breakthrough yield (i.e., 5-10% increase) that is economically feasible. Furthermore, the pulp fibers from such pulping process should exhibit equivalent or enhance physical properties to those of the convention, lower yield pulping processes.

Two of the critical areas of performance for paperboard packaging are stiffness and bulk. Therefore, the packaging industry strives for paper/paperboard with high stiffness at the lowest basis weight possible in order to reduce the weight of paper/paperboard needed to achieve a desired stiffness and, therefore, reduce raw material cost.

One conventional approach to enhance the board stiffness is through using single-ply paperboard with a higher basis weight. However, a single-ply paperboard with an increased basis weight is economically undesirable because of a higher raw material cost and higher shipping cost for the packaging articles made of such board.

Another conventional practice is to use multi-ply paperboard having at least one middle or interior ply designed for high bulk performance with top and bottom plies designed for stiffness. U.S. Pat. No. 6,068,732 teaches a method of producing a multi-ply paperboard with an improved stiffness. Softwood is chemically pulped, and the resulting fiber pulps are screened into a short fiber fraction and a long fiber fraction. The outer plies of paperboard are made of the softwood long fiber fraction. The center ply of paperboard is formed from a mixture of the softwood short fiber fraction and chemically pulped hardwood fibers. The paperboard has about 12-15% increase in Taber stiffness. PCT Patent Application No. 2006/084883 discloses a multi-ply paperboard having a first ply to provide good surface properties and strength and a second ply comprising hardwood CTMP (chemi-thermomechanical) pulps to provide bulkiness and stiffness.

Multi-ply paperboards are commonly prepared from one or more aqueous slurries of cellulosic fibers concurrently or sequentially laid onto a moving screen. Production of multi-ply board requires additional processing steps and equipments (e.g., headbox and/or fourdrinier wire) to the single ply boards. Conventionally, a first ply is formed by dispensing the aqueous slurry of cellulosic fibers onto a long horizontal moving screen (fourdrinier wire). Water is drained from the slurry through the fourdrinier wire, and additional plies are successively laid on the first and dewatered in similar manner. Alternatively, additional plies may be formed by means of smaller secondary fourdrinier wires situated above the primary wire with additional aqueous slurries of cellulosic fibers deposited on each smaller secondary fourdrinier wire. Dewatering of the additional plies laid down on the secondary fourdrinier wires is accomplished by drainage through the wires usually with the aid of vacuum boxes associated with each fourdrinier machine. The formed additional plies are successively transferred onto the first and succeeding plies to build up a multi-ply mat. After each transfer, consolidation of the plies must be provided to bond the plies into a consolidated multi-ply board. Good adhesion between each ply is critical to the performance of multi-ply board, leading to an additional factor that may deteriorate board properties. The plies must be bonded together well enough to resist shear stress when under load and provide Z-direction fiber bond strength within and between plies to resist splitting during converting and end use. However, a multiply-ply paperboard with an increased basis weight is economically undesirable because of a higher production cost and higher shipping cost for the packaging articles made of such board.

Therefore, there is a need for paperboard having an enhanced stiffness at a lower basis weight that is more economical than conventional single-ply and multi-ply paperboards.

SUMMARY OF THE INVENTION

The present disclosure relates to producing paper or paperboard having improved stiffness and strength, compared to the conventional paperboard at the same basis weight. It also discloses a method of wood pulping having a significantly increased yield and providing fiber pulps with enhanced properties such as strength and stiffness.

Wood chips are chemically pulped to a high kappa number, providing a rejects component and an accepts component. The rejects component is subjected to a substantially mechanical pulping process, optionally in a presence of bleaching agent, prior to blending back into the accepts component. The resulting fiber blend is washed, optionally in a presence of bleaching agent, and subjected to a papermaking process to provide paper or paperboard with enhanced strength and stiffness at low basis weight.

DETAILED DESCRIPTION OF THE INVENTION

The preferred embodiments of the present inventions now will be described more fully hereinafter, but not all possible embodiments of the invention are shown. Indeed, these inventions may be embodied in many different forms and should not be construed as limited to the embodiments set forth herein; rather, these embodiments are provided so that this disclosure will satisfy applicable legal requirements. The detailed description is not intended to limit the scope of the appended claims in any manner.

Figure 1:
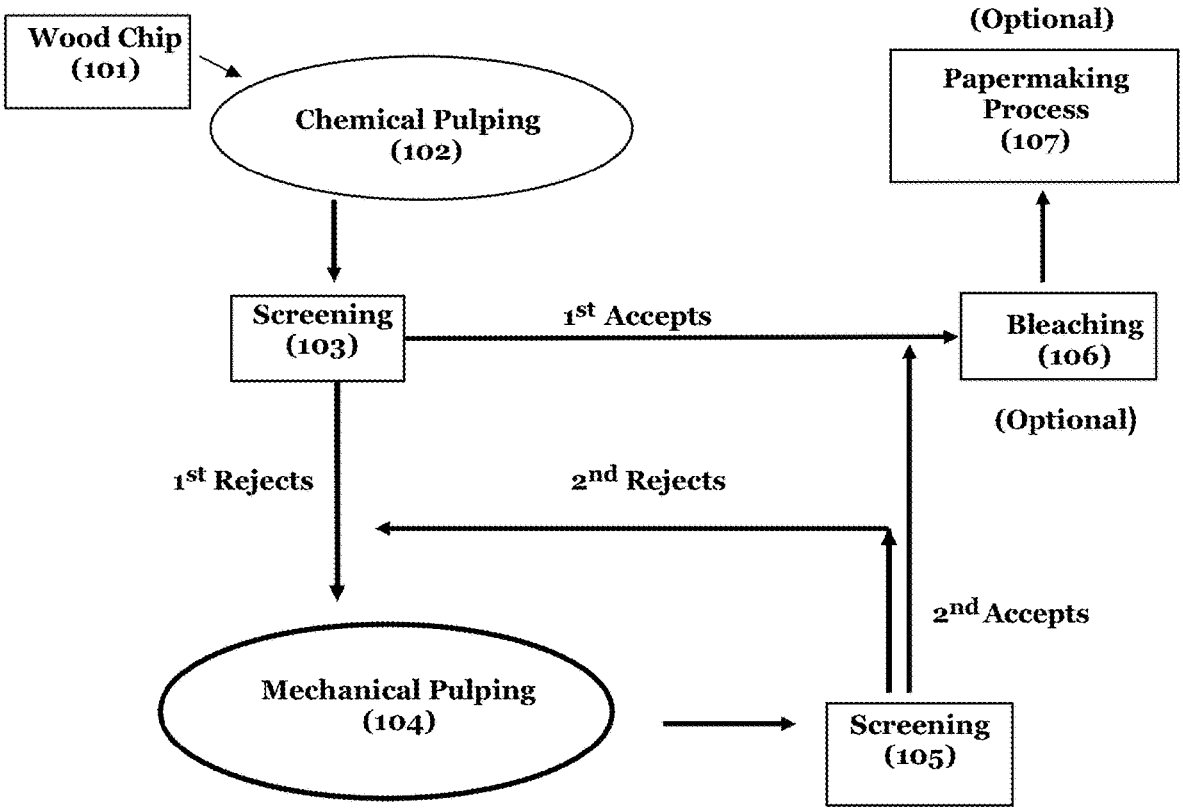
FIG. 1 is a schematic diagram showing one embodiment of the pulping process of the present disclosure.

FIG. 1 shows the pulping process of the present disclosure. Wood chips provided in (101) are subjected to a chemical pulping (102) to provide a first amount of pulp. The first amount of pulp is screened at (103) to separate the first rejects component from the first accepts component. The first rejects component is then subjected to a substantially mechanical pulping process (104), providing the second rejects component and the second accepts component. The second accepts component is separated from the second rejects component through screening (105). The second rejects component is combined with the first reject component and sent back to the substantially mechanical pulping processing (104). The second accepts component is blended with the first accepts component, providing a fiber blend. The resulting fiber blend may be subjected to bleaching (106) prior to a papermaking process (107) or subjected directly to a papermaking process (107).

The substantially mechanical pulping process used for treating the rejects component of the present disclosure may be any mechanical process performed in a presence of chemical agent(s). Such chemical agent may be the chemical compound retained in the rejects component from the chemical pulping of wood chips, or the chemical compound added during the mechanical pulping of the rejects components, or combinations thereof.

Figure 2:
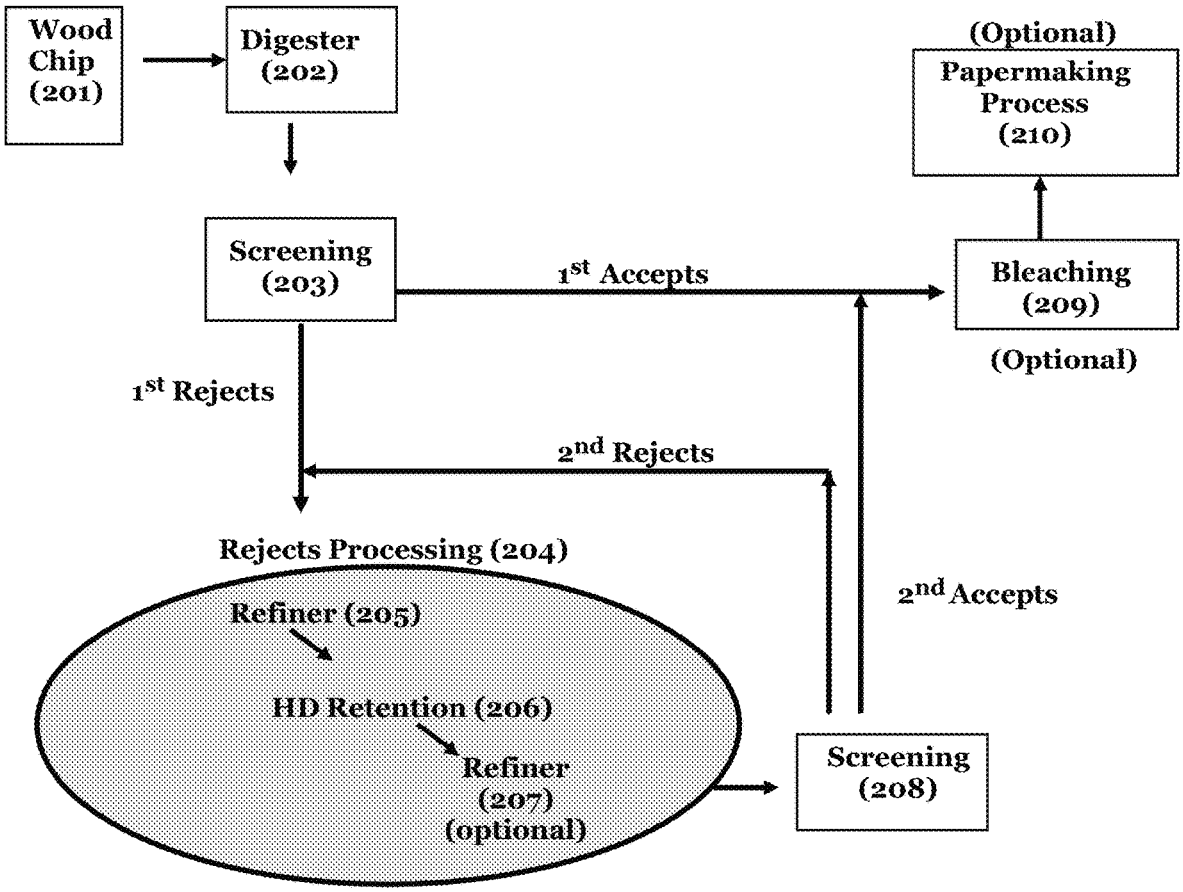
FIG. 2 is a schematic diagram showing one embodiment of the pulping process of the present disclosure.

A more specific embodiment of the pulping process is disclosed in detail in FIG. 2. Wood chips provided in (201) are subjected to a chemical pulping (202) in a digester, providing the first amount of pulp. The first amount of pulp is screened at (203) to separate the first rejects component from the first accepts component. The first rejects component is then put through a rejects processing procedure (204), where the first rejects component is subjected to a high consistency refining (205) and then discharged into a retention device (206) for a predetermined retention time. The resulting refined pulps may be further subjected to at least one more refining process (207), or sent directly to a screening (208) without an additional refining process to separate the second rejects component from the second accepts component. The second rejects component is combined with the first reject component and sent back to the substantially mechanical pulping processing (204). It is to be understood that FIG. 2 represents one example of such rejects processing, but other mechanisms for the rejects processing procedure may be used in the present disclosure. The second accepts component is blended with the first accepts component, providing a fiber blend. The resulting fiber blend may be subjected to bleaching (209) prior to a papermaking process (210), or subjected directly to a papermaking process (210).

The chemical pulping process of the wood chips is designed to provide about 6-50% weight of the rejects component, which is unlike a conventional kraft process that typically generates about 1-5% weight of the rejects component. In some embodiments, the pulping process provides about 30-35% weight of the rejects component. In order to obtain such an extraordinary high level of the rejects component, kraft pulping for bleachable grade is carried to a kappa number range of about 20-70 for hardwood and 30-95 for softwood, compared to a kappa number of less than 20 for conventional hardwood and less than 30 for a conventional softwood processes. In some embodiments, the pulping process is carried out to a kappa number of about 55. As is known in the art, several operational parameters for pulping may be adjusted and optimized to achieve pulping with such high kappa number. These parameters include, but are not limited to, lower cooking temperature, lower cooking time, reduced chemical level, and combinations thereof.

The resulting pulp fibers are screened through a multistage screening process to separate the first rejects component from the first accepts component. For example, the resulting pulp fibers may be screened through a coarse barrier screen, and subsequently through a second primary screen consisting of fine slots or small holes. The collected rejects component may be further screened through two to three levels of slotted or hole screens to separate a pure reject stream from a stream of good, debris free fiber capable of passing through a typical bleachable grade fiber slot or hole.

The first rejects component obtained from a screening process is subjected to a rejects processing step, which is substantially a mechanical pulping process. A variety of mechanisms may be used for the rejects processing. In one example, the rejects component is thickened to about 30% consistency and subjected to a high consistency refining in a presence or absence of bleaching agent(s). The compositions and amounts of the bleaching agents may be adjusted to ensure peroxide stabilization and good fiber refinability. The bleaching agent and the rejects component may be added simultaneously to the refiner, or the bleaching agent(s) may be added to the rejects component after the refining process. The rejects component may be refined in either an atmospheric or pressurized refiner using about 5-30 hpd/ton energy. The refined rejects component is then discharged into a retention device for a retention time of about 0-60 minutes. In some embodiments of the present disclosure, the refined rejects are retained for about 30 minutes. Subsequently, the resulting treated rejects component may either be screened through a fine slotted, multistage screening or passed through a set of low consistency secondary refiners and then through a multi-stage screening process, generating the second accepts component and the second rejects component. The second accepts component is blended back to a stream of the first accepts component, while the second rejects component is fed back to the rejects processing step for a further treatment.

The refining process suitable for use in the present disclosure may be a pure mechanical, a thermal mechanical, or a chemi-thermomechanical process. Any known mechanical techniques may be used in refining the fibers of the present disclosure. These include, but are not limited to, beating, bruising, cutting, and fibrillating fibers.

Suitable bleaching agents for use in bleaching include, but are not limited to, chlorine dioxide, sodium hypochlorite, sodium hydrosulfite, elemental chlorine, ozone, peroxide, and combinations thereof. Furthermore, the pulp may be bleached by an oxygen delignification process or by an extraction with base in the presence of peroxide and/or oxygen. In some embodiments of the present disclosure, the rejects component is bleached with bleaching liquor consisting of peroxide, caustic, and sodium silicate.

The second accepts component is blended back into a stream of the first accepts component, providing a fiber blend. In some embodiments of the present disclosure, about 70% by weight of the first accepts component is blended with about 30% by weight of the second accepts component. The ratio of the first accepts component to the second accepts component will typically be similar to the ratio of the first accepts component to the first rejects component produced in the first screening process. If the fibers are for an unbleached grade of paper or paperboard, the resulting blended fibers may be further subjected to a traditional papermaking processes. If the fibers are for a bleached grade paper/paperboard, the resulting blended fibers may be bleached prior to being subjected to a traditional papermaking processes. Several bleaching techniques may be used, including subjecting the fiber blend to an oxygen delignification process or passing the fiber blend directly to a conventional or ozone containing bleach plant.

The fibers used in the present disclosure may be derived from a variety of sources. These include, but are not limited to, hardwood, softwood, or combinations thereof.

The wood pulping process of the present disclosure provides an increased yield in a range of about 8-20% compared to conventional pulping processes. Additionally, when the process of the presence disclosure is carried out to a higher kappa number, the pulp yield further increases but at a higher processing cost. (TABLE 1) This substantial yield improvement is even higher than the level considered as a breakthrough innovation defined by the DOE Agenda 20/20 program (i.e., 5-10% yield increase). The fibers obtained from the described pulping process provide paper or paperboard with improved stiffness at a lower basis weight compared to the paper or paperboard comprising conventional pulps, and yet without any reduction in tear strength, tensile strength, and other physical properties.

TABLE 1

| Pulp Type | Conventional Pulping Process | Pulping Process of the Present Disclosure | Increase in % Yield |
|---|---|---|---|
| Unbleached Pulp | 50% | 65% | 15% |
| Bleached Pulp | 46% | 54% | 8% |

The fiber blends of the present disclosure provide paperboard with higher stiffness, at the same bulk, than the paperboard made of conventional fibers. (TABLE 2) This significant improvement in stiffness at the same bulk may allow a mill to reduce the fiber level conventionally required for producing paperboard with the same stiffness level by 13%.

TABLE 2

| | Stiffness Level (mN) | |
|---|---|---|
| Bulk Level ($cm^3/g$) | Conventional Kraft Fiber | Fiber of the Present Disclosure |
| 1.35 | 3 | 16 |
| 1.40 | 10 | 23 |
| 1.50 | 23 | 32 |

Additionally, the paper/paperboard made with the disclosed fibers provides a desired strength property at a lower basis weight than those made of the conventional kraft pulps. The single ply-paper/paperboard made of the disclosed fibers at an unconventionally low basis weight shows strength and stiffness characteristics approaching those of conventional multi-ply paper/paperboard. Therefore, the disclosed novel pulping process allows a single-ply paper/paperboard to be used in the end use markets that have been limited to only a multi-ply paper/paperboard due to the desired high strength. The paperboard containing the fibers of the present disclosure may be used for packaging a variety of goods. These include, but are not limited to, tobacco, aseptic liquids, and food.

Examples

Hardwood chips were Kraft pulped in a digester to a kappa number of 50 to provide a first amount of pulp containing a first accepts component and a first rejects component. The first accepts component was separated from the first rejects component using a 0.006" slotted screen. The first rejects component was then thickened to 30% consistency, and then refined and pre-bleached by an APMP type alkaline pulping process using alkaline peroxide in a high consistency refiner to generate a second amount of pulp containing a second accepts component and a second rejects component. The second accepts component was separated from the second rejects component and shives using a 0.008" slotted screen, and then from the smaller fiber bundles that passed the 0.008" screen using a 0.006" slotted screen.

The resulting second accepts component was added back to a stream of the first accepts component. The resulting fiber blend, comprising 70% by weight of the first accepts component and 30% by weight of the second accepts component, was bleached to about 87 GE brightness and then subjected to a Prolab refining at two different energy levels: 1.5 hpd/ton and 3.0 hpd/ton. The resulting refined fibers were measured for a degree of freeness (CSF) using the TAPPI standard procedure No. T-227. The resulting refined fibers were also tested for the amount of light weight fines (% LW fines on a length-weighted basis), the length, width, fiber coarseness, and fiber deformation properties such as curl, kink, and kirk angle. A Fiber Quality Analyzer (FQA) instrument was used to obtain these measurements.

Figure 3:
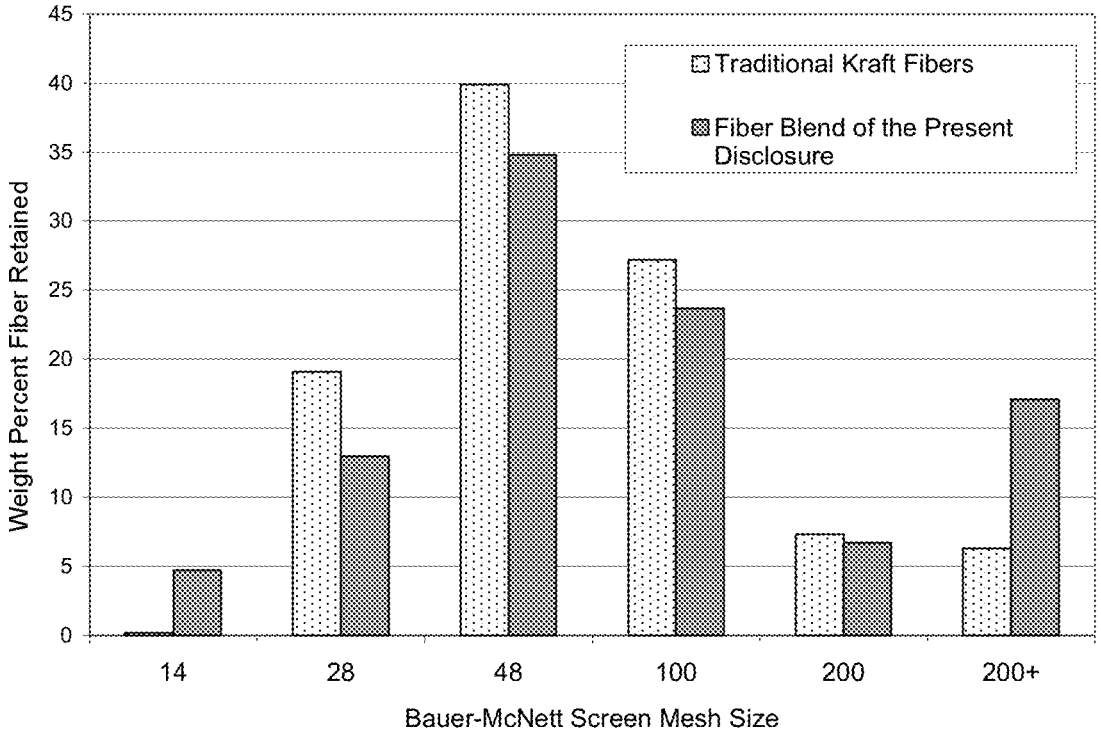
FIG. 3. is a graph showing weight percents of the fibers retained on the Bauer-McNett screen of different mesh sizes for the fiber blend of the present disclose and for the conventional Kraft fibers.

Additionally, the fiber length distribution of the resulting fiber blend was determined using a Bauer-McNett Classifier and compared to that of the conventional kraft fibers. The Bauer-McNett Classifier fractionates a known weight of pulp fiber through a series of screens with continually higher mesh numbers. The higher the mesh number, the smaller the size of the mesh screen. The fibers larger than the size of the mesh screen are retained on the screen, while the fibers smaller than the size of the mesh screen are allowed to pass through the screen. The weight percent fiber retained on the screens of different mesh sizes was measured. (TABLE 3, FIG. 3)

TABLE 3

| | Fiber Retained (Weight Percent) | |
|---|---|---|
| Bauer-McNett Screen Size, Mesh Size | Traditional Kraft Fiber | Fiber Blend of the Present Disclosure |
| 14 | 0.2 | 4.73 |
| 28 | 19.1 | 12.97 |
| 48 | 39.9 | 34.81 |
| 100 | 27.2 | 23.69 |
| 200 | 7.3 | 6.7 |
| 200+ | 6.3 | 17.1 |

The disclosed fiber blend showed a fiber length distribution containing at least 2 weight percent of long fibers and at least 15 weight percent of short fibers, as defined by the 14 mesh-size and 200 mesh-size screens of the Bauer-McNett classifier. On the contrary, traditional kraft fiber pulp contained less than 0.5 weight percent of long fibers (i.e., fibers retained on a 14 mesh-size screen), and less than 8 weight percent of short fibers (i.e., fibers passed through a 200 mesh-size screen).

The fiber length distribution of the disclosed fiber blend is much broader than that of traditional kraft fibers. The fiber blend of the present disclosure has a higher level of long fibers than the convention kraft fiber pulp, as shown by an increase in weight percent of the fiber retained on the 14 mesh-size screen. Furthermore, the fiber blend of the present disclosure has a significantly higher level of short fibers than the convention kraft fiber pulp, as indicated by a substantial increase in weight percent of the fiber passing through a 200 mesh-size screen.

The fiber blend at the same rejects ratio, but without being refined in a Prolab refiner was used as a starting point to determine the impact of refining energy upon fiber physical property development. Additionally, hardwood pulps obtained from a pulp washing line in a commercially operating kraft pulping process were subjected to a Prolab refining process using 1.5 and 3.0 hpd/t, and used as controls.

The fiber blend of the present disclosure showed a lower freeness and higher level disclosed pulp blend had a greater degree of fiber deformation than the baseline pulp, especially with regard to fiber kink. (TABLE 4)

TABLE 4

| Sample | Refining Energy (hpd/t) | CSF (ml) | % LW Fines | Fiber Length (mm) | Fiber Width (microns) | Fiber Deformations Curl | Kink | Kink Angle |
|---|---|---|---|---|---|---|---|---|
| Control | 0 | 640 | 13.47 | 0.990 | 20.9 | 0.083 | 1.27 | 21.63 |
| | 1.5 | 510 | 13.64 | 1.021 | 20.5 | 0.073 | 1.11 | 18.96 |
| | 3.0 | 390 | 13.08 | 0.975 | 20.4 | 0.073 | 1.06 | 17.71 |
| Blend | 0 | 540 | 10.37 | 1.018 | 22.4 | 0.100 | 1.46 | 26.73 |
| | 1.5 | 390 | 14.53 | 0.950 | 20.6 | 0.087 | 1.34 | 22.52 |
| | 3.0 | 240 | 15.15 | 0.899 | 20.6 | 0.079 | 1.41 | 22.16 |

Modified TAPPI board-weight handsheets (120 g/m$^2$ basis weight) made of the disclosed fiber blend were produced and tested for tensile energy absorption (TEA), strain, elastic modulus, and maximum loading value using the TAPPI standard procedure No. T-494. Furthermore, the handsheets were tested for internal bonding strength based on Scott Bond test as specified in the TAPPI standard procedure No. T-569 and Z-direction tensile (ZDT) strength using the TAPPI standard procedure No. T-541.

At a given level of applied refining energy, the handsheets made of the disclosed fiber blend had higher tensile energy absorption (TEA), strain, maximum loading values, and elastic modulus than those of handsheets made of the control pulps. Moreover, the strength properties enhanced as the energy applied to the pulps in a Prolab refiner increased. The handsheets were also tested for the internal bond strength based on Scott Bond value and Z-direction strength. The handsheets of the disclosed pulp blend showed higher internal bond strength than those of handsheets made of the control pulps. When compared at equivalent freeness or bulk levels, the strength properties for the disclosed blend pulps are similar to the control pulp. (TABLE 5)

TABLE 5

| Sample | Refining Energy (hpd/t) | CSF (ml) | TEA (lb/in) | Strain (%) | Max Load (lbf) | Modulus (Kpsi) | Max Load (inch) | Scott bond (0.001ft-lbs/in$^2$) | ZDT (psi) |
|---|---|---|---|---|---|---|---|---|---|
| Control | 0 | 640 | 0.47 | 2.30 | 16.6 | 415.4 | 0.121 | 101.9 | 56.4 |
| | 1.5 | 510 | 0.84 | 3.22 | 21.6 | 475.4 | 0.167 | 148.1 | 89.7 |
| | 3.0 | 390 | 1.21 | 3.91 | 26.6 | 521.7 | 0.202 | 279.1 | 100.6 |
| Blend | 0 | 540 | 0.86 | 3.10 | 23.0 | 487.1 | 0.161 | 149.7 | 84.5 |
| | 1.5 | 390 | 1.25 | 3.63 | 28.6 | 596.5 | 0.188 | 261.8 | 104.6 |
| | 3.0 | 240 | 1.91 | 5.30 | 31.1 | 555.3 | 0.272 | 329.7 | 98.7 |

Additionally, the handsheets were tested for physical properties such as L&W stiffness based on the TAPPI standard procedure Lorentzen & Wettre No. T-556, smoothness based on Sheffield smoothness as described in the TAPPI standard procedure No. T-538, and fold endurance based on MIT fold endurance as described in the TAPPI standard procedure No. T-511. The handsheets made of the disclosed fibers had lower caliper, and therefore lower bulk, than those made of the control pulps at the same levels of refining energy. However, even at those lower bulk levels, the handsheets of the disclosed pulp blend showed about the same level of L&W bending stiffness (measured as it was and as indexed for differences in basis weight) as the handsheets made of the control pulps. Therefore, compared at the same bulk, the handsheets of the disclosed fibers had a significantly improved bending stiffness, compared to the handsheets made of the control pulps. Smoothness and fold values are essentially the same for the control and blend pulps when compared at constant bulk levels. (TABLE 6)

TABLE 6

| Sample | Refining Energy (hpd/t) | CSF (ml) | Basic Weight (g/m$^2$) | Soft Caliper mils | Soft Caliper bulk | L&W Bending Stiffness As was | L&W Bending Stiffness bw index | Sheffield Smoothness | MIT Fold (#folds) |
|---|---|---|---|---|---|---|---|---|---|
| Control | 0 | 640 | 121.9 | 7.32 | 1.52 | 44.5 | 42.5 | 294.3 | 23 |
| | 1.5 | 510 | 123.7 | 6.44 | 1.32 | 22.6 | 20.7 | 216.0 | 90 |
| | 3.0 | 390 | 123.0 | 5.71 | 1.18 | 3.0 | 2.8 | 206.2 | 534 |
| Blend | 0 | 540 | 126.0 | 6.37 | 1.28 | 28.1 | 24.3 | 239.2 | 79 |
| | 1.5 | 390 | 128.6 | 5.77 | 1.14 | 25.3 | 20.5 | 129.3 | 856 |
| | 3.0 | 240 | 124.8 | 5.11 | 1.04 | 3.5 | 3.1 | 278.0 | 2170 |

The disclosed fibers impart an improved bending stiffness; therefore, a lower amount of fiber furnish is needed to obtain a given stiffness and thereby reducing the required basis weight of the finished paper/paperboard to achieve a given stiffness. Fiber furnish is the highest cost in papermaking process. The ability to reduce the amount of fiber in the furnish in the present disclosure provides a significant economic and performance competitive advantage compared to the conventional pulping process.

It is to be understood that the foregoing description relates to embodiments that are exemplary and explanatory only and are not restrictive of the invention. Any changes and modifications may be made therein as will be apparent to those skilled in the art. Such variations are to be considered within the scope of the invention as defined in the following claims.

We claim:

1. A process for producing a fiber blend comprising steps of:

(a) chemically pulping hardwood chips by kraft pulping to a kappa number of not less than 30 by reacting the hardwood chips with chemicals under pressure and temperature to separate pulp fibers from lignin by partially removing lignin from the hardwood chips to generate a first amount of pulp including a first accepts component and a first rejects component wherein the ratio of the weight of the first rejects component to the weight of the first amount of pulp comprises about 20% to about 50%;

(b) separating the first accepts component from the first rejects component;

(c) thickening the separated first rejects component;

(d) performing a high consistency substantially mechanical pulping of the thickened first rejects component utilizing between about 5 to about 30 of energy per ton of the first rejects component to generate a second amount of pulp including a second accepts component and a second rejects component;

(e) separating the second accepts component from the second rejects component; and (f) combining the first and the second accepts components to create the fiber blend, wherein the fiber blend has at least one of: a fiber length distribution containing at least 2 weight percent of long fibers; and a fiber length distribution containing at least 15 weight percent of short fibers.

2. The process of claim 1 wherein the ratio of the weight of the first rejects component to the weight of the first amount of pulp comprises about 30% to about 35%.

3. The process of claim 1 wherein the separating step in step (b) comprises a step of passing the first amount of pulp through a screen to separate the first accepts component from the first rejects component.

4. The process of claim 1 wherein the high consistency substantially mechanical pulping comprises a pulping process selected from the group consisting of mechanical pulping, alkaline mechanical pulping, alkaline thermo mechanical pulping, thermo mechanical pulping, and chemithermomechanical pulping.

5. The process of claim 1 wherein the high consistency substantially mechanical pulping comprises a pulping process selected from the group consisting of alkaline peroxide mechanical pulping and alkaline thermo mechanical pulping.

6. The process of claim 1 wherein the high consistency substantially mechanical pulping comprises a step of refining the first rejects component.

7. The process of claim 1 wherein the high consistency substantially mechanical pulping of the first rejects component generates the second amount of pulp including the second rejects component.

8. The process of claim 1 wherein the ratio of the weight of the first accepts component to the weight of the fiber blend comprises about 50% to about 80%.

9. The process of claim 1 wherein the hardwood chips have a weight associated therewith, wherein the fiber blend has a weight associated therewith, and wherein the weight of the fiber blend is at least 45% of the weight of the hardwood chips.

10. The process of claim 1 wherein the substantially mechanical pulping of the first rejects component utilizes between about 5 to about 30 hpd of energy per ton of the first rejects component.

11. The process of claim 1 wherein the substantially mechanical pulping of the first rejects component utilizes between about 5 to about 15 hpd of energy per ton of the first rejects component.

12. The process of claim 1 further comprising producing paperboard from the fiber blend.

13. The process of claim 1 wherein a yield of the process is in a range of about 8% to about 20% higher than a conventional pulp process yield of 50%.

14. The process of claim 1 wherein the fiber blend has a fiber length distribution containing at least 2 weight percent of long fibers.

15. The process of claim 1 wherein the fiber blend has a fiber length distribution containing at least 15 weight percent of short fibers.

16. The process of claim 1 wherein the fiber blend has a fiber length distribution containing at least 2 weight percent of long fibers and at least 15 weight percent of short fibers.

17. A process for producing a fiber blend comprising steps of:

(a) chemically pulping wood chips by kraft pulping to a kappa number of not less than 50 by reacting the hardwood chips with chemicals under pressure and temperature to separate pulp fibers from lignin by partially removing lignin from the hardwood chips to generate a first amount of pulp including a first accepts component and a first rejects component;

(b) separating the first accepts component from the first rejects component;

(c) thickening the separated first rejects component;

(d) substantially mechanical pulping the thickened first rejects component at a high consistency utilizing between about 5 to about 30 of energy per ton of the first rejects component to generate a second amount of pulp including a second accepts component and a second rejects component;

(e) separating the second accepts component from the second rejects component; and (f) combining the first and the second accepts components to create a fiber blend, wherein the fiber blend has at least one of: a fiber length distribution containing at least 2 weight percent of long fibers; and a fiber length distribution containing at least 15 weight percent of short fibers.

18. The process of claim 17 wherein the kappa number is not less than 55.

19. The process of claim 17 wherein the ratio of the weight of the first rejects component to the weight of the first amount of pulp comprises about 20% to about 50%.

20. The process of claim 17 wherein the separating step (b) comprises a step of passing the first amount of pulp through a screen to separate the first accepts component from the first rejects component.

21. The process of claim 17 wherein the high consistency pulping comprises alkaline peroxide mechanical pulping and alkaline thermo mechanical pulping.

22. The process of claim 17 wherein the high consistency substantially mechanical pulping comprises a step of refining the first rejects component.

23. The process of claim 17 wherein the fiber blend includes a first weight associated therewith, wherein the first accepts component includes a first weight associated therewith, and wherein the ratio of the first weight of the first accepts component to the first weight of the fiber blend comprises about 50% to about 90%.

24. The process of claim 17 wherein the fiber blend includes a first weight associated therewith, wherein the first accepts component includes a first weight associated therewith, and wherein the ratio of the first weight of the first accepts component to the first weight of the fiber blend comprises about 65% to about 75%.

25. The process of claim 17 wherein the wood chips have a weight associated therewith, wherein the fiber blend has a weight associated therewith, and wherein the weight of the fiber blend is at least 45% of the weight of the wood chips.

* * * * *